United States Patent [19]

Gloersen

[11] Patent Number: 4,836,893

[45] Date of Patent: Jun. 6, 1989

[54] APPARATUS FOR TREATMENT OF FIBER MATERIAL

[76] Inventor: Stig T. Gloersen, P1 45012-Edsgatan, 655 90 Karlstad, Sweden

[21] Appl. No.: 850,434

[22] Filed: Apr. 8, 1986

Related U.S. Application Data

[63] Continuation of Ser. No. 750,223, Jun. 28, 1985, abandoned, which is a continuation of Ser. No. 204,060, Nov. 4, 1980, abandoned, which is a continuation of Ser. No. 785,543, Apr. 7, 1977, abandoned, which is a continuation of Ser. No. 592,661, Jul. 2, 1975, abandoned.

[30] Foreign Application Priority Data

Jul. 5, 1974 [SE] Sweden ..... 7408859

[51] Int. Cl.[4] ..... D21C 7/00; D21C 7/06; D21C 9/02

[52] U.S. Cl. ..... 162/237; 162/243; 162/246; 68/181 R

[58] Field of Search ..... 162/17, 19, 60, 237, 162/243, 246, 248, 251; 23/290.5, 280, 283; 68/181 R; 422/261, 264

[56] References Cited

U.S. PATENT DOCUMENTS

| | | | |
|---|---|---|---|
| 2,730,888 | 1/1956 | Seely et al. | 68/181 R |
| 3,380,883 | 4/1968 | Richter et al. | 162/237 |
| 3,619,348 | 11/1971 | Asplund | 162/19 |
| 4,056,429 | 11/1977 | Richter et al. | 162/17 |

*Primary Examiner*—Steve Alvo

*Attorney, Agent, or Firm*—Birch, Stewart, Kolasch & Birch

[57] ABSTRACT

A method and apparatus for continuous fiber material treatment of a fiber column without compaction of the column. A liquid layer is disposed between upper and lower treatment zones (i.e. between a cook and wash zone), and apparatus is provided for interrupting the fiber column of the upper zone. The apparatus may include a conical table which generally supports the fiber column of the upper zone yet allows passage of fiber material from the upper zone to the lower zone to allow formation of another fiber column in the lower zone. The liquid layer area may be of the same or smaller cross-sectional area than the upper zone, and the lower zone may be horizontally offset from the upper zone if desired.

4 Claims, 2 Drawing Sheets

APPARATUS FOR TREATMENT OF FIBER MATERIAL

This is a continuation of application Ser. No. 750,233filed Nov. 4, 1980, now abandoned, which is a continuation of Ser. No. 785,543, filed Apr. 7, 1977, and now abandoned, which is a continuation of Ser. No. 542,661, filed July 2, 1975, and now abandoned.

BACKGROUND AND SUMMARY OF THE INVENTION

The invention relates to a method and apparatus for continuous digestion of wood chips, bagasse, and other finely divided fiber containing material. Conventional continuous digestors, such as shown in U.S. Pat. No. 3,380,883, provide for a number of treatment steps of a fiber column in the same vessel at various vertical positions in the vessel. Impregnation, cooking, and washing may all take place in the same vessel, and other steps, such as bleaching, may also take place, and the fiber material may be heated, cooled, diluted, dewatered, have chemicals added thereto, or otherwise be treated. In order for all such treatment steps in large volume to be properly carried out in a single vessel it is necessary to make the continuous digestor very tall. The great height of the fiber column and the liquid in the digestor, however result in large liquid pressure and fiber compaction. The fiber compaction may become so great that the free flow of liquid through the fiber column at the bottom portions thereof—which free flow is necessary for proper treatment of the fiber material—is prevented and so great that the evenness of the continuous fiber column movement is prevented. Also, the evenness of the liquid flow over the entire free cross-section of the digestor at the lower parts thereof—which even liquid flow is also necessary for proper treatment—may be prevented.

According to the present invention, a method and apparatus are provided that remedy the above-mentioned problems often existing in prior art digestors. In particular, according to the present invention, the compaction of fiber material in the lower portions of the digestor vessel is minimized so that free, even flow of liquid therethrough is permitted. This is accomplished by interrupting the fiber column of the vessel at one or more places along the height thereof, preferably at the transition areas between treatment zones, and by passing the fiber column through a liquid layer. For instance, in a continuous digestor having impregnating, cooking, and washing zones, the height of the fiber column is interrupted between the cooking and washing zones, and washing—while taking place vertically below the cooking zone—may be accomplished without interference due to compaction of fiber column. Also, since a new liquid layer is provided washing may take place with a higher dilution factor.

According to a preferred apparatus of the present invention, a table is provided at the transition area between various zones of a digestor, the table having formed around the periphery thereof an area in which the fiber material in the column may fall from the upper zone to the lower zone of the zones interrupted by the table. The table supports the weight of the fiber column above it, and a space is provided between the table and a fiber column which is re-formed in the zone below the table so that compaction does not occur. Liquid from the upper zone is removed near the table interface, and new liquid is introduced to the lower zone from beneath the table. Under normal circumstances the lower zone is vertically in line with the upper zone, however if preferred, the lower zone may be spaced from the vertical axis of the upper zone.

According to the present invention, the following advantages may be realized: Less fiber compaction, therefore better treatment (i.e. washing) of the fiber material. Ability to eliminate some screens from the treatment vessel, and thereby avoid problems of clogging, etc., that are often associated therewith. The ability to use less expensive materials in forming the lower zone compartments of the vessel, and to use less energy to pump the liquids from and between zones, etc.

The term "zone" as used in the specification is equivalent to the term "chamber", and these terms are used interchangeably.

It is the principal object of the present invention to provide an improved method and improved apparatus for continuous treatment of fiber material in a column. This and other objects of the invention will become clear from an inspection of the detailed description of the invention, and from the appended claims.

DETAILED DESCRIPTION OF THE INVENTION

Figure 1:
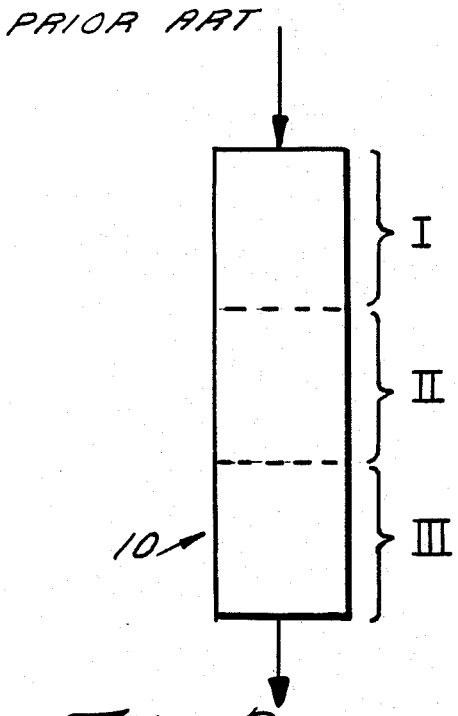
FIG. 1 is a schematic showing of a prior art continuous digestor vessel having impregnating, cooking, and washing zones.

A typical prior art continuous digestor 10, such as disclosed in U.S. Pat. No. 3,380,883, is shown schematically in FIG. 1, having three zones, I, II, and III. Zone I may be where the fiber material to be digested is impregnated with liquid, steam, or both, at digestor pressure; zone II may be a cooking zone; and zone III may be a washing zone. Of course other different or accessory stages or zones could be provided, and the vessel 10 could include any conventional treating equipment. Insuch a digestor, the vertical height of a fiber (and liquid) column therein may be very large—large enough to cause fiber compaction, and large liquid pressures (which interfere with back washing)—which interfere with proper treatment of the fiber material at the lower portions of the digestor 10, such as in the washing zone III.

Figure 2:
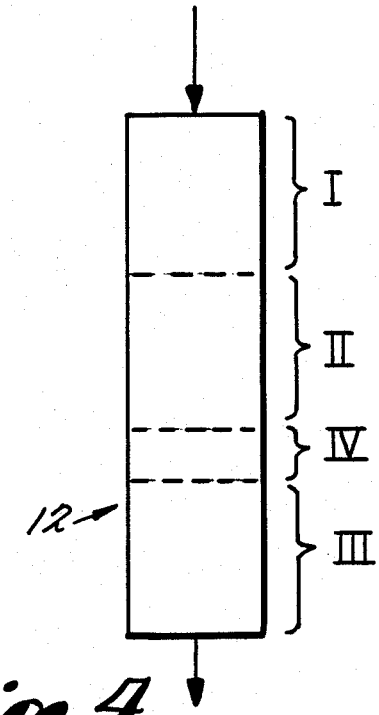
FIG. 2 is a schematic view of an exemplary digestor according to the present invention.
Figure 3:
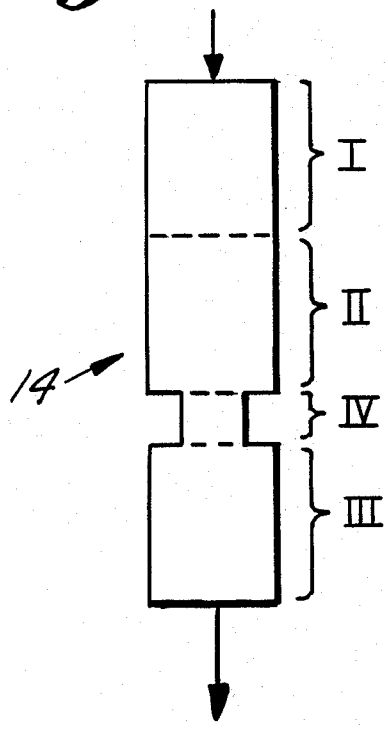
FIGS. 3 and 4 are schematic views of other embodiments of a digestor according to the present invention.
Figure 4:
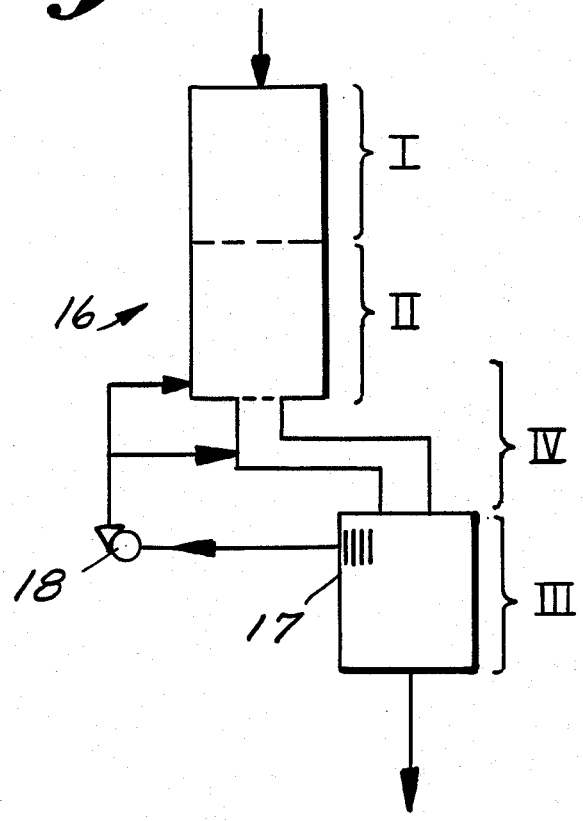

Digestors according to the present invention—which minimize fiber compaction, etc.—are shown schematically at 12, 14, and 16 in FIGS. 2, 3, and 4 respectively. In digestor 12 an interrupting zone IV of substantially the same cross-section as the rest of the digestor is disposed between the cooking zone II and the washing zone III. In digestor 14, an interrupting zone IV of smaller cross-section than the rest of the digestor is disposed between the cooking zone II and the washing zone III. In FIG. 4, an interrupting zone IV of smaller cross-section than the rest of the digestor 16, and offset from the center-line of the zones I and II of the digestor 16, is provided, and the zone IV connects the zone II with the washing zone III, which is alSo offset from the center-line of zone II. The washing zone III of the digestor 16 may be screenless, or—as shown—may be of the type having a screen 17. Liquid from the washing zone III is withdrawn by pump 18 through screen 17, and is fed into lower part of the zone II, and into the zone IV. The surplus liquid in these areas transports the fiber material through the zone IV.

In the FIG. 4 embodiment, since the washing zone is separate the advantage of reduced static liquid pressure may be attained, whereby the wash container itself may be designed for a lower pressure, and thus constructed of cheaper materials. The power consumption of pumps, and other component parts, also may be significantly reduced. With a separate wash zone, it is important that the fiber material is transported to the wash zone from the digestor without being defibrated or broken into parts to any considerable degree. Defibration results in a poorer wash. Defibration can be minimized by transferring the fiber material from the digestor to the wash zone by means of digestor pressure, and by suitably regulating the pressure difference between the rest of the digestor 16 and the wash zone III.

Figure 5:
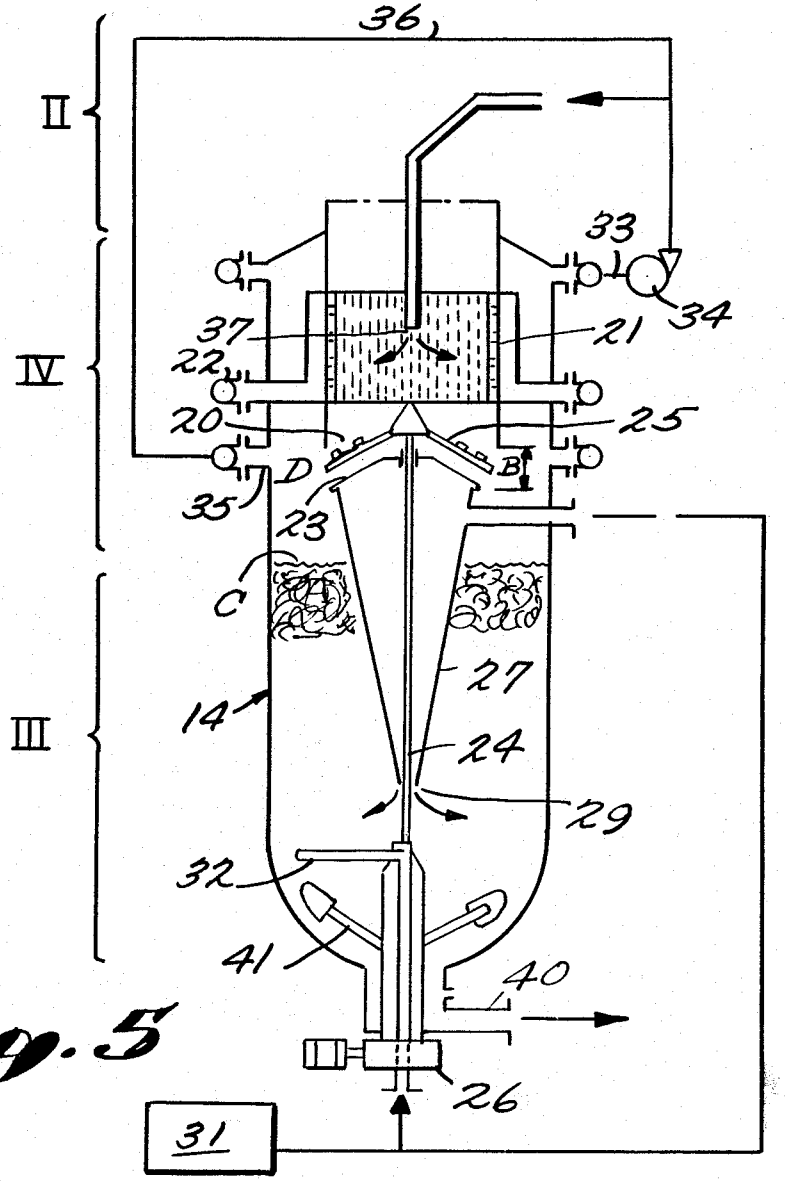
FIG. 5 is a detailed view of the washing, interrupting, and part of the cooking zone of an exemplary digestor according to the present invention.

Portions of a digestor 14 according to the present invention are shown in more detail in FIG. 5. FIG.5 shows the washing zone, interrupting zone, and the lower portion of the cooking zone of the digestor 14. The fiber column in the cooking zone II passes downwardly through the cylindrical member 20 into zone IV, a liquid layer D being maintained in zone IV. A cylindrical screen 21 may be provided in the cylinder 20, through which the cooking liquid is withdrawn and passed via passageway 22 to be treated at a chemical recovery plant or the like.

Fiber material passing downwardly through the cylinder 35 (which is maintained in a fiber column of predetermined height in zone II) contacts a table member 23, which table interrupts the column, and supports the column of fiber material thereabove. As shown in the drawings, the table 23 may be stationary, having an outwardly downwardly sloping conical configuration with a flat top portion. Alternatively, the table 23 may be rotatable with scrapers attached thereto for moving fiber material accumulated thereon toward the periphery thereof. At the periphery of the table 23 is located a gap B between the bottom of the cylinder 20 and the top surfaces of the table 23. Fiber material passes through the gap B to the interior of the washing zone III, and assumes a level C therein (means—not shown—for maintaining the level at C may be provided). It will be seen that since the level C is below the gap B, and since the table 23 supports the weight of the fiber column thereabove, the amount of compaction of the fiber column is minimized. If the table 23 is rotatable (as by a shaft 24), the scrapers attached thereto will assist the fiber material in passing through the gap B. If the table 23 is stationary, and accessory scraping and feeding device 25 located above the table 23 should be provided. The scraper 25 is rotated by power means 26 or the like through shaft 24, and assists the fiber material in flowing through gap B.

Located vertically below the table 23 in zone III is a conical liquid container 27, having inwardly downwardly sloped side walls 28 thereof. Located at the bottom of the container 27 is an opening 29, which distributes wash liquid from the interior of the container 27 into the fiber column maintained within the zone III. The wash liquid may be a weak cooking liquor, water, or the like, and is fed into the container 27 by line 30 from a source 31. Wash liquid is also introduced into the fiber column within zone III through rotatable sprayer 32, which is rotatable by motor 26 or the like and is connected to source 31.

The washing liquid is introduced through the means 29 and 32 into the fiber column in such quantity and in such a way that an upflow of washing liquid is established —that is counter to the downward flow of the fiber column—that results in duffusioin washing of the fiber material. The existence of a liquid layer over the level C of the fiber material (the liquid layer extending upwardly to near the top of zone IV), the withdrawal of liquid peripherally above the level of C fiber material, and the conical shape of the walls 28 of container 27 allow a extraction of upwardly flowing wash liquid from across the whole fiber material cross-section, which constitutes an improvement over conventional systems, a more even washing being obtained. The velocity of the upwardly flowing liquid in zone IV is controlled so that it is less than the downward velocity of the fiber material which may require some accessory means at the largest point of container 27, where the cross-sectioned area of zone IV is the smallest. Liquid is withdrawn from the zone IV through connection 33 by a pump 34 or the like, and liquid that does not flow upwardly is withdrawn through the digestion outlet 40, along with treated fiber material, assisted by stirrer 41.

As mentioned above, the fiber materials passing through gap B sinks under the action of gravity in the liquid layer D above the fiber column level C. In addition to scraper 25 or the like, other means may be provided for assisting the downward flow of the fiber materal. This may comprise a tangentially arranged opening 35 or the like through which liquid is introduced into zone IV at about the level of the gap B, resulting in an eddy current which facilitates downward movement of the fiber material. Liquid may be introduced into the opening 35 from pump 34 via line 36. Also, liquid from line 36 may be introduced into cylinder 20 by tube 37, which displaces the cooking liquid, forcing it through screen 21, and assists in downward movement of the fiber material. Liquid may also be introduced through nozzles (not shown) in the feeding device 25 to help avoid unnecessary defibration of the fiber material. A cylinder 50, having a lowermost edge of 51 thereof, extends between the zone II and the liquid layer D over the level C of fiber material in zone III.

Figure 6:
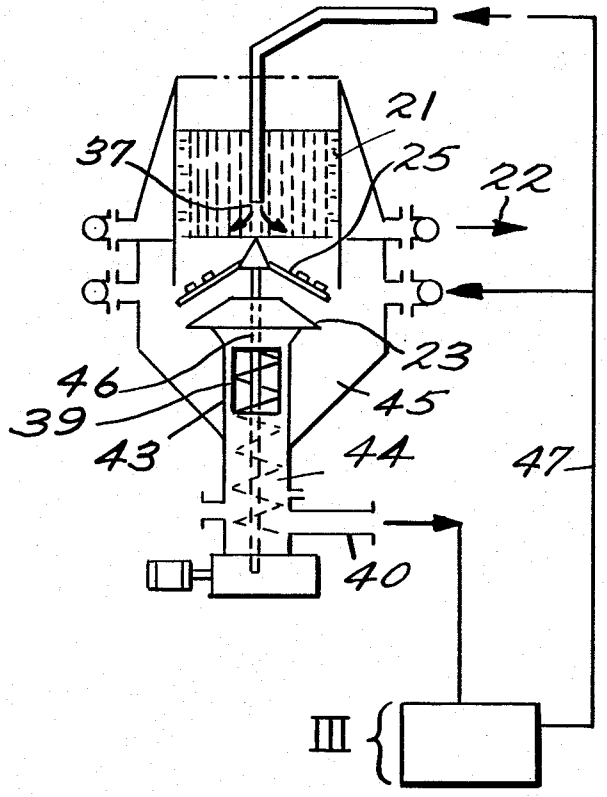
FIG. 6 is a detailed view of a portion of the cooking zone and the interrupting zone according to the embodiment of the present invention shown in FIG. 4.

An alternative embodiment of the invention, such as shown schematically in FIG. 4, is shown in more detail in FIG. 6. Like reference numerals in the FIG. 5 and FIG. 6 embodiments refer to like components. In FIG. 6 only zone IV and the lower part of zone II are shown. The washing zone III is separate from the rest of the digestor 16, and communication with zone IV is provided through outlet 40. As in FIG. 5 embodiment, the fiber column of zone II is interrupted by table 23, and the cooking liquid is withdrawn through screen 21 or the like. Washing liquid from nozzle 37 may replace the cooking liquid. Instead of a conical container being formed under the table 23, however, a substantially cylindrical hollow body 43 is formed, which is fastened to the bottom of the digestor 16 and has a portion 44 extending outwardly therefrom, the portion 44 being in open communication with the outlet 40. Inside digestor 16, one or more openings 39 are formed in hollow body 43, through which fiber material flowing through the gap B may pass after having passed through the liquid chamber 45 (containing the liquid layer D) of the digestor 16. A transport screw 48 or the like rotates centrally within the body 43, powered by shaft 46, which may also drive the table 23 and/or scraper 25. The screw 48 feeds the fiber material in a relatively thin suspension downwardly toward the outlet 40.

Connected to the outlet 40 is a wash zone (not shown) which is separate from the rest of the digestor, and not in vertical alignment therewith (see FIG. 4). The thin fiber suspension passing through body 43 under digestor pressure passes through outlet 40 into the top of the wash zone, from which a portion of the liquid may be withdrawn and pumped back to the digestor 16 via line 47. Utilization of the room 45 and means 43 according to the FIG. 6 embodiment of the invention avoids defibration, so that proper washing may still be accomplished although the wash zone is separate from and vertically offset from the rest of the digestor 16.

The method of the present invention may be easily gleaned from an inspection of the pereferred apparatus described above. Fiber material or the like is continuously treated in a first (i.e. cook) treatment zone and a second (i.e. wash) treatment zone (and one or more other (i.e. impregnation) zones if desired), the first zone being located above the second zone and being in open communication therewith. The method includes the steps of establishing a fiber material column of a predetermined height in the first zone, establishing a liquid layer (D) between the first and second zones, interrupting the fiber column of the first zone so that the weight of the column in the first zone is not transferred to fiber material in said second zone, whereby compaction of fiber material in said second zone is minimized, while allowing passage of fiber material from the first zone to the second zone, and re-forming a fiber column, with fiber material from said first zone, under said liquid layer and in said second zone, which re-formed fiber column is located vertically below and spaced vertically from said fiber column in said first zone and is not compacted by the weight thereof.

It will thus be seen that a method and apparatus have been herein illustrated and described that fulfill the objects of the present invention.

While the invention has been herein shown and described in what is presently conceived to be the most practical and preferred embodiments, it will be apparent to those of ordinary skill in the art that many modifications may be made thereof within the scope of the invention, which scope is to be according the broadest interpretation of the appended claims so as to encompass all equivalent structures and methods.

What is claimed is:

1. Apparatus for continuously treating fiber material and the like in a first treatment chamber and in a second treatment chamber and in a second treatment located after said first chamber and in open communication therewith, said apparatus comprising (a) a treatment vessel having a fiber inlet and a fiber outlet, said first and second chambers being defined in said treatment vessel, (b) means for establishing a fiber column of a predetermined height in said first chamber, (c) means establishing a liquid layer between said first and second chambers, (d) means for re-forming a fiber column in said second chamber with fiber material from said first chamber, (e) means for interrupting said fiber column of said first chamber, so that the weight thereof is not transferred to the fiber material in said re-formed fiber column in said second chamber while allowing passage of fiber material from said fiber column in said first chamber to said fiber column in said second chamber, said interrupting means including a cylinder extending between said first chamber and said liquid layer and providing a fiber communicating path therebetween, said cylinder having a lowermost edge thereof, and a table having downwardly outwardly sloping conical portions and located in said liquid layer, said conical portions being vertically spaced from the lowermost edge of said cylinder and being located above the level of the re-formed fiber column in said second chamber, and (f) means for introducing washing liquid near the bottom of said second chamber, portions of said washing liquid flowing upwardly toward and into said liquid layer and removed peripherally therefrom, said wash introducing means including a downwardly inwardly conical sloping liquid container located below said table and concentric with said second chamber and said liquid layer, said container having an outlet at the bottom thereof in communication with said second chamber.

2. Apparatus as recited in claim 1, wherein said table is stationary and wherein said apparatus further comprises means for facilitating movement of fiber material from said first chamber to said second chamber through the gap between said table and said lowermost edge of said cylinder, said means comprising a rotatable scraper concentric with said table and located thereabove.

3. Apparatus as recited in claim 2 wherein said fiber material movement facilitating means further comprises means for establishing a liquid eddy current near the space between said table and said lowermost edge of said cylinder.

4. Apparatus for continuously treating fiber material and the like comprising (a) first and second treatment vessels, a first treatment chamber being in said first treatment vessel and a second treatment chamber being in said second treatment vessel located vertically below and horizontally offset from said first treatment vessel, and in open communication therewith, (b) means for establishing a fiber column of a predetermined height in said first chamber, (c) means establishing a liquid layer between said first and second chamber, (d) means for re-forming a fiber column in said second chamber with fiber material from said first chamber, (e) means for interrupting said fiber column of said first chamber so that the weight thereof is not transferred to the fiber material in said re-formed fiber column in said second chamber while allowing passage of fiber material from said fiber column in said first chamber to said fiber column in said second chamber, said interrupting means including a cylinder extending between said first chamber and said liquid layer and providing a fiber communicating path therebetween, said cylinder having a lowermost edge thereof, and a table having downwardly outwardly sloping conical portions and located in said liquid layer, said portion being vertically spaced from the lowermost edge of said cylinder and being located above the level of the reformed fiber column in said second chamber, and (f) means for transferring fiber material from said first chamber to said second chamber without defibration, said transferring means comprising a cylindrical hollow body located below and substantially concentric with said table, an opening in said hollow body providing communication between said liquid layer and the interior of said hollow body, and a feeding screw rotatble about a vertical axis located within said hollow body for feeding fiber material downwardly therethrough to said second chamber.

* * * * *